US007682199B2

(12) United States Patent
Ahn et al.

(10) Patent No.: US 7,682,199 B2
(45) Date of Patent: Mar. 23, 2010

(54) CONNECTOR

(75) Inventors: Hae-Won Ahn, Gumi-si (KR); Jong-Sun Kim, Chilgok-gun (KR); Yoshifumi Kubota, Tokyo (JP); Hideyuki Ohtani, Tokyo (JP); Yosuke Saito, Tokyo (JP)

(73) Assignees: Samsung Electronics Co., Ltd., Suwon-si (KR); Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/111,487

(22) Filed: Apr. 29, 2008

(65) Prior Publication Data

US 2008/0280465 A1 Nov. 13, 2008

(30) Foreign Application Priority Data

May 7, 2007 (JP) ..... 10-2007-0122774
Apr. 14, 2008 (KR) ..... 10-2008-0034144

(51) Int. Cl.
*H01R 24/00* (2006.01)

(52) U.S. Cl. ..... 439/660

(58) Field of Classification Search ..... 439/660, 439/607.54, 607.24, 607.25, 607.27, 607.04, 439/607.35, 607.39

See application file for complete search history.

(56) References Cited

U.S. PATENT DOCUMENTS 5,145,411 A * 9/1992 Pastal et al. ..... 439/598
5,593,311 A * 1/1997 Lybrand ..... 439/295
5,941,733 A * 8/1999 Lai ..... 439/607.01

FOREIGN PATENT DOCUMENTS

KR 1020040077018 9/2004

OTHER PUBLICATIONS

Korean Search / Examination Report dated Aug. 4, 2009.

* cited by examiner

*Primary Examiner*—Phuong K Dinh
(74) *Attorney, Agent, or Firm*—H.C. Park & Associates, PLC

(57) ABSTRACT

A housing includes a plurality of contacts has a flat plate-shaped fitting portion projecting from a body portion to fit to a mating connector. The fitting portion has first and second main surfaces that are opposite each other and a pair of side surfaces connecting between those main surfaces. The contacts each have a contact portion disposed on the first main surface. The fitting portion is provided with a metal cover portion. The metal cover portion extends along a periphery of the fitting portion to cover the second main surface and the pair of side surfaces.

9 Claims, 3 Drawing Sheets

CONNECTOR

CROSS REFERENCE TO RELATED APPLICATION

This application claims priority from and the benefit of Japanese Patent Application No. 10-2007-0122774, filed on May 7, 2007 and Korean Patent Application No. 10-2008-34144, filed on Apr. 14, 2008, which are hereby incorporated by reference for all purposes as if fully set forth herein.

BACKGROUND OF THE INVENTION

1. Field of the Invention

This invention relates to a connector adapted to be connected to a mating connector by fitting.

2. Discussion of the Background

Generally, in a connector of this type, a plurality of conductive contacts are held by a plastic housing. The housing has a fitting portion that may be removably fitted to a mating connector. Contact portions of the contacts are protected by the fitting portion of the housing. A pinch force may be applied when detaching the mating connector, which may damage the fitting portion. If the fitting portion is damaged, the contact portions of the contacts may not be sufficiently protected.

For example, Korean Patent Application Publication No. 2006-331679 discloses a connector having a rectangular frame-shaped housing. Contacts are provided at particular wall portions of the housing. Further, metal members are attached at the other wall portions of the housing.

In the structure of Korean Patent Application Publication No. 2006-331679, the metal members may not prevent damage to the particular wall portions provided with the contacts. Therefore, these wall portions may be damaged when detaching a mating connector, thereby rendering the protection of contact portions of the contacts insufficient. Further, if the metal members come off the wall portions of the housing even partially, fitting of the mating connector may be impeded.

SUMMARY OF THE INVENTION

The present invention provides a connector including a fitting portion having a damage prevention structure with high reliability.

The present invention also provides a connector that prevents the damage prevention structure from separating from the connector.

Additional features of the invention will be set forth in the description which follows, and in part will be apparent from the description, or may be learned by practice of the invention.

The present invention discloses a connector including a plurality of contacts and a housing holding the contacts. The housing includes a body portion and a flat plate-shaped fitting portion projecting from the body portion to fit with a mating connector. The fitting portion has a first main surface, a second main surface opposite the first main surface, and a pair of side surfaces connecting the first and second main surfaces. Each contact has a contact portion disposed on the first main surface, and the fitting portion is provided with a metal cover portion. The metal cover portion extends along a periphery of the fitting portion to cover the second main surface and the pair of side surfaces.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
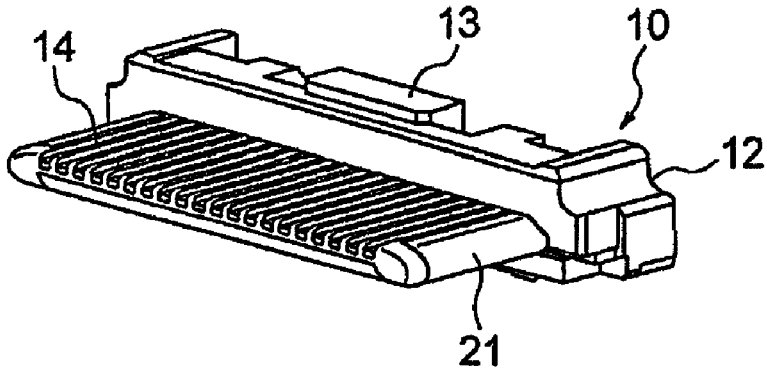
FIG. 1 is a perspective view from a first direction of a connector according to an exemplary embodiment of this invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

According to a connector of this invention, since there is provided a metal cover portion extending over a second main surface of a fitting portion, which is opposite its first main surface where contact portions of contacts are disposed, and a pair of side surfaces thereof, it may be possible to reliably prevent damage to the fitting portion.

Figure 2:
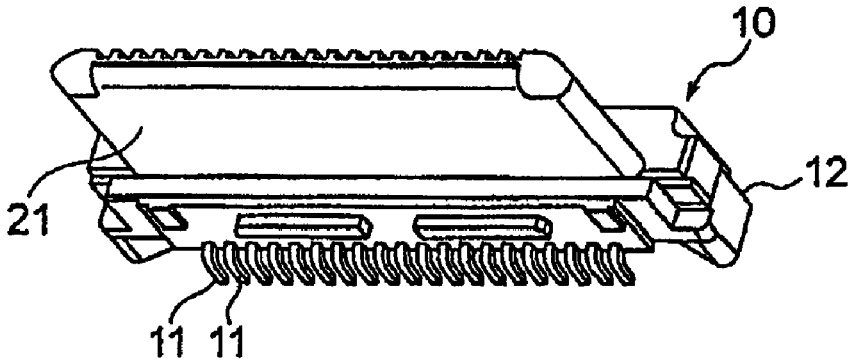
FIG. 2 is a perspective view of the connector of FIG. 1 from a second direction.
Figure 3:
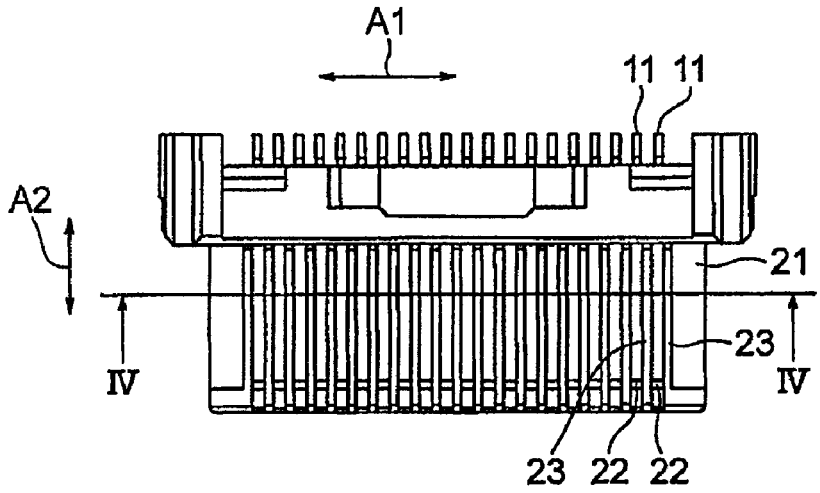
FIG. 3 is a plan view of the connector shown in FIG. 1 and FIG. 2.
Figure 4:
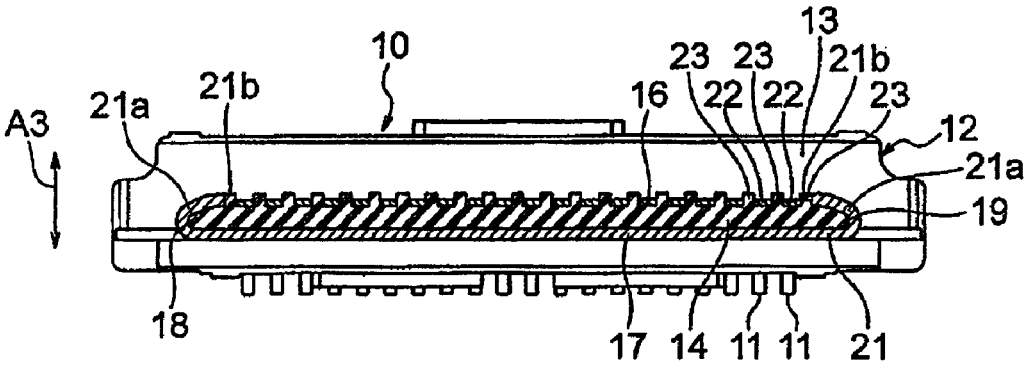
FIG. 4 is an enlarged sectional view taken along line IV-IV of FIG. 3.

Referring to FIG. 1, FIG. 2, FIG. 3, and FIG. 4, the structure of a connector according to an exemplary embodiment of this invention will be described. FIG. 1 is a perspective view from a first direction of the connector according to an exemplary embodiment of this invention. FIG. 2 is a perspective view of the connector of FIG. 1 from a second direction. FIG. 3 is a plan view of the connector shown in FIG. 1 and FIG. 2. FIG. 4 is an enlarged sectional view taken along line IV-IV in FIG. 3.

The connector 10 includes a plurality of conductive contacts 11 arranged in a first direction A1 and a plastic insulating housing 12 holding these contacts 11. The housing 12 integrally has a body portion 13 elongated in the first direction A1 and a flat plate-shaped fitting portion 14 projecting from the body portion 13 in a second direction A2 perpendicular to the first direction A1. The fitting portion 14 has first and second main surfaces 16 and 17 opposite to each other in a third direction (an up-down direction) A3 perpendicular to the first and second directions A1 and A2 and a pair of side surfaces 18 and 19 connecting those main surfaces 16 and 17.

The fitting portion 14 is provided with a metal cover portion 21 for protection. The cover portion 21 may be integrally formed with the housing 12 by molding and extends along the periphery of the fitting portion 14 to cover the second main surface 17 and the pair of side surfaces 18 and 19. The cover portion 21 further extends from the pair of respective side surfaces 18 and 19 to also cover end portions of the first main surface 16. In other words, both end portions 21*a* of the cover portion 21 are fitted on the outer sides of corresponding end portions of the fitting portion 14. The cover portion 21 covers the second main surface 17 and the pair of side surfaces 18 and 19 over the entire projecting length of the fitting portion 14.

The contacts 11 each have a contact portion 22 disposed on the first main surface 16. The first main surface 16 includes a plurality of projecting stripes 23 and the contact portions 22 are disposed between the projecting stripes 23. These contact portions 22 are arranged in the first direction A1 between both end surfaces 21*b* of the cover portion 21. In other words, the cover portion 21 covers the entire periphery of the fitting portion 14 except the contact portions 22 and the projecting stripes 23.

The projecting stripes 23 integrally formed with the fitting portion 14 are interposed between the adjacent contact portions 22, respectively. The projecting stripes 23 are also interposed in the same manner between both end surfaces 21*b* of the cover portion 21 and the contact portions 22 at ends, respectively. In this manner, the contact portions 22 are insulated between themselves and with respect to the cover portion 21. On the first main surface (upper surface) 16, an upper surface of the cover portion 21 and an upper surface of each projecting stripe 23 may be equal to each other in height, while an upper surface of each contact portion 22 is set slightly lower.

Figure 5:
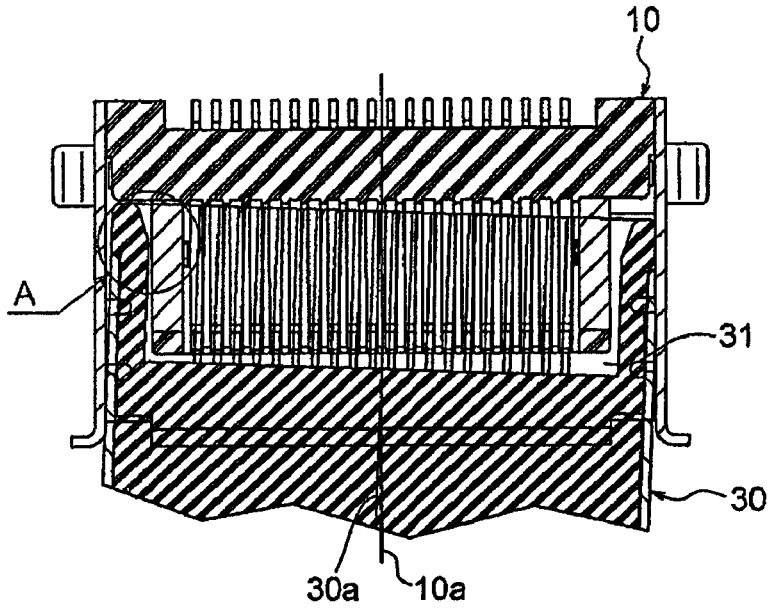
FIG. 5 is a sectional view showing a fitting state between the connector shown in FIG. 1, FIG. 2, FIG. 3, and FIG. 4 and a mating connector.
Figure 6:
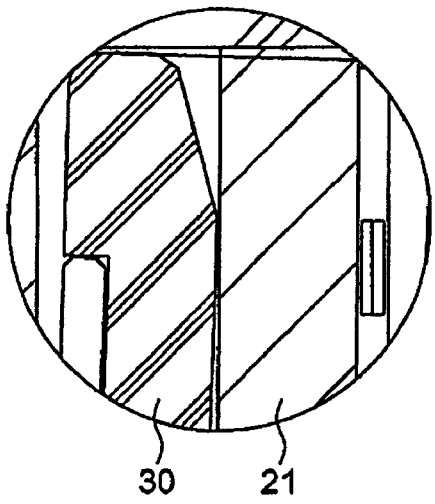
FIG. 6 is an enlarged view of portion A in FIG. 5.

Next, the operation of the foregoing connector will be described referring to FIG. 5 and FIG. 6. FIG. 5 is a sectional view showing a fitting state between the connector 10 shown in FIG. 1, FIG. 2, FIG. 3, and FIG. 4 and a mating connector 30. FIG. 6 is an enlarged view of portion A in FIG. 5.

In FIG. 5 and FIG. 6, the fitting portion 14 of the connector 10 is fitted into a fitting recess 31 of the mating connector 30. Here, it is assumed that a central axis 10*a* of the connector 10 and a central axis 30*a* of the mating connector 30 are slightly askew and, as a result, part of the connector 10 is brought into contact with the mating connector 30 at portion A. Even if the connector 10 collides with the mating connector 30, since the metal cover portion 21 of the connector 10 contacts with the mating connector 30, damage to the plastic fitting portion 14 may be prevented.

For example, if a pinch force is applied when detaching the mating connector 30, the mating connector 30 may collide with the connector 10. However, even in that case, the fitting portion 14 is protected by the cover portion 21 and thus may be prevented from being damaged. Therefore, it is unlikely that the contact portions 22 of the contacts 11 will be subjected to damage.

In the above, the description has been given of the case where the central axis 10*a* of the connector 10 and the central axis 30*a* of the mating connector 30 are slightly askew. However, since the upper surface of the cover portion 21 and the upper surface of each projecting stripe 23 are equal to each other in height, even in the case where inclination occurs in a direction A3, damage to the fitting portion 14 due to collision with the mating connector 30 may be prevented.

This invention is applicable not only to the connector of the type shown in the drawings, but also to various types of connectors.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed:

1. A connector, comprising:

a plurality of contacts; and a housing holding the contacts, the housing comprising:

a body portion, and a flat plate-shaped fitting portion projecting from the body portion, the fitting portion to fit with a mating connector, wherein the fitting portion comprises a first main surface and a second main surface opposite to each other and a pair of side surfaces connecting between the first main surface and the second main surface, wherein each contact has a contact portion disposed on the first main surface, the fitting portion is provided with a metal cover portion, and the metal cover portion is integrally formed with the housing by molding and extends along a periphery of the fitting portion to cover the second main surface and the pair of side surfaces.

2. The connector of claim 1, wherein the fitting portion further comprises a plurality of projecting stripes on the first main surface, the contact portions being disposed between the projecting stripes, and the cover portion covers the entire periphery of the fitting portion except the contact portions and the projecting stripes.

3. The connector of claim 2, wherein a height of an upper surface of each projecting stripe from the first main surface and a height of an upper surface of the cover portion from the first main surface are substantially equal to each other.

4. The connector according to claim 1, wherein the cover portion extends to portions of the first main surface adjacent to the pair of side surfaces.

5. The connector of claim 1, wherein the cover portion covers the pair of side surfaces over an entire projecting length of the fitting portion.

6. The connector of claim 1, wherein the cover portion covers the second main surface over an entire projecting length of the fitting portion.

7. The connector of claim 3, wherein an upper surface of each contact portion is disposed lower than the upper surface of the cover portion and the upper surface of each projecting stripe.

8. The connector of claim 2, wherein the projecting stripes are integrally formed with the fitting portion.

9. The connector of claim 1, wherein the fitting portion projects in a direction perpendicular to a direction along which the contacts are arranged.

* * * * *